United States Patent [19]

Watanabe et al.

[11] Patent Number: 4,690,348

[45] Date of Patent: Sep. 1, 1987

[54] APPARATUS FOR WINDING A SHEET-FORMED ARTICLE

[75] Inventors: Kenji Watanabe; Hiroshi Kato, both of Aichi; Katsunori Onishi, Shinsakae, all of Japan

[73] Assignee: Inoue Mtp Kabushiki Kaisha, Nakamura, Japan

[21] Appl. No.: 780,592

[22] Filed: Sep. 26, 1985

[30] Foreign Application Priority Data

Nov. 21, 1984 [JP] Japan ..... 59-177133[U]

[51] Int. Cl.[4] ..... B65H 18/08

[52] U.S. Cl. ..... 242/66; 242/74

[58] Field of Search ..... 242/56 R, 56 A, 65, 242/67.2, 74, 66

[56] References Cited

U.S. PATENT DOCUMENTS

| | | | |
|---|---|---|---|
| 3,134,553 | 5/1964 | Gelleke | 242/56 R |
| 3,633,840 | 1/1972 | Clark | 242/56 R |
| 3,721,396 | 3/1973 | Morizzo | 242/56 R |
| 4,000,863 | 1/1977 | Straujups | 242/56 R |
| 4,002,308 | 1/1977 | Feighery | 242/66 |
| 4,102,512 | 7/1978 | Lewallyn | 242/66 |

*Primary Examiner*—Stuart S. Levy
*Assistant Examiner*—David Werner
*Attorney, Agent, or Firm*—Schwartz & Weinrieb

[57] ABSTRACT

An apparatus which allows automatic winding of a sheet-formed article such as, for example, of foamed rubber without being influenced by the material or dimensions of the article. In the apparatus, an end of a sheet-formed article which is continuously transported by a conveyor is turned over to partially surround and press against the periphery of a tubular takeup member by means of an attaching roller assembly. Then, the turned over end of the sheet-formed article is pushed to a position below the tubular takeup member by means of a presser so that the end of the article is wrapped between the tubular takeup member and the sheet-formed article being fed by the conveyor and is thus fixedly attached to the tubular takeup member, thereby allowing subsequent automatic winding of the sheet-formed article onto the tubular takeup member to be effected by rotation of the tubular takeup member.

20 Claims, 5 Drawing Figures

APPARATUS FOR WINDING A SHEET-FORMED ARTICLE

FIELD OF THE INVENTION

This invention relates to an apparatus for automatically winding onto a tubular member a continuously fed sheet-formed article of flexible foamed rubber.

BACKGROUND OF THE INVENTION

A sheet-formed article made of flexible foamed rubber such as urethane formed rubber is stored and conveyed while being held wound on a tubular member such as of paper for convenience in handling.

Normally, a sheet-formed article is continuously formed such that an elongated block of flexible foamed rubber is levelled into a predetermined thickness of material by means of a blade while it is being moved. As a sheet-formed article is supplied continuously in such a way, winding thereof onto a tubular member is preferably effected automatically by a machine.

Thus, various winding apparatus have been proposed so far. In such winding apparatus, however, it is required that sheet-formed articles be constant or fixed in dimensions and materials. However, such sheet-formed articles are often varied suitably in dimensions and materials in conformity with applications thereof, and several types of sheet-formed members are often produced on the same manufacturing line. Accordingly, the conventional apparatus cannot deal properly with such conditions.

In this way, in the conventional apparatus, it is impossible to automatically wind various sheet-formed articles, and two workers are normally required for attaching an end of a sheet-formed article to a takeup tube.

OBJECT OF THE INVENTION

The present invention has been made in consideration of such circumstances as described above, and it is an object of the invention to provide an apparatus for winding a sheet-formed article which enables such automatic winding that has been impossible with prior art apparatus.

SUMMARY OF THE INVENTION

In order to resolve such problems as described above, the present invention is characterized in that it comprises a conveyor for transporting a sheet-formed article thereon, a tubular takeup member mounted for rotation above the conveyor, means for turning over an end of the sheet-formed article fed by the conveyor to cause the sheet-formed article to surround and be pressed against substantially half the peripheral region of the tubular takeup member, and a pressing element for pushing the end of the sheet-formed article turned over by the aforenoted means to a position below the tubular takeup member.

BRIEF DESCRIPTION OF THE DRAWING

Now, the present invention will be described in connection with a preferred embodiment thereof illustrated in the accompanying drawings, wherein.

DETAILED DESCRIPTION OF THE INVENTION

Figure 1:
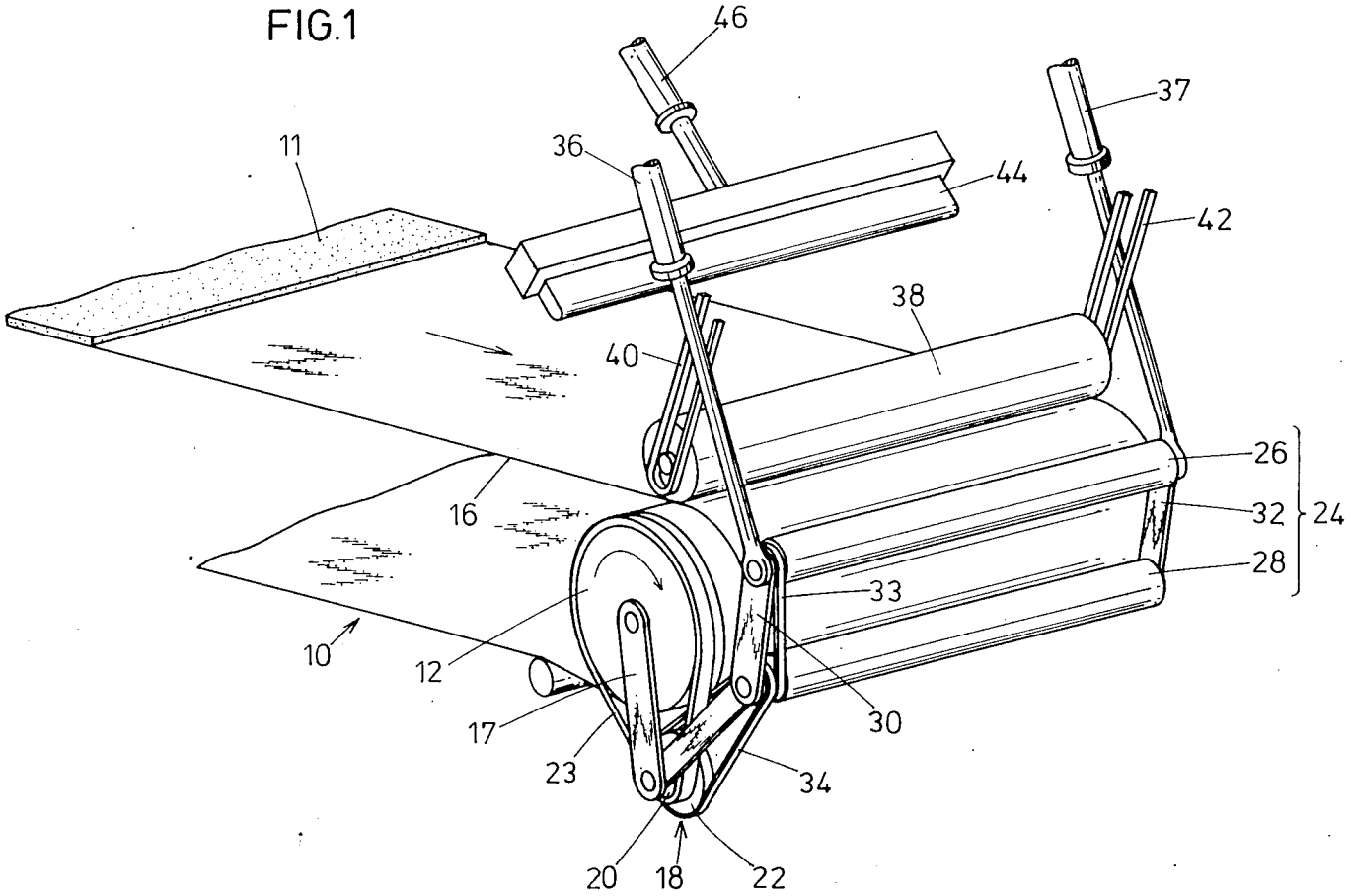
FIG. 1 is a perspective view illustrating a winding apparatus of a preferred embodiment of the prsent invention.

The drawings show a preferred embodiment of the present invention, and in the drawings, FIG. 1 is a perspective view of essential part of a winding apparatus, and FIGS. 2 to 5 are side elevational views, in schematic representation of the winding apparatus, illustrating various stages of winding a sheet-formed article.

A continuously fed sheet-formed article 11 of flexible foamed rubber such as urethane foamed rubber is transported across a winding apparatus by a conveyor 10 such as, for example, a belt 16 extending between a driving drum 12 and a rotary drum 14.

A transmission roller 18 is supported for movement around the driving drum 12 by means of an arm 17 and has two belt receiving portions 20 and 22. A belt 23 extends between the belt receiving portion 20 of the transmission roller 18 and the driving drum 12 so that the transmission roller 18 may be rotated in the same direction with the driving drum 12.

An attaching roller assembly 24 includes a jumping roller 26 and a backup roller 28 supported for rotation in a spaced relationship on a pair of arms 30 and 32. The two rollers 26 and 28 are connected to rotate in the same direction by a belt 33. The backup roller 28 is connected to the belt receiving portion 22 of the transmission roller 18 by another belt 34. Accordingly, the jumping roller 26 and the backup roller 28 are rotated in the same direction with the transmission roller 18 and hence with the driving drum 12. The attaching roller assembly 24 can be moved between a position forwardly of the driving drum 12 and another position above the driving drum 12 by expansion and contraction of a pair of jumping cylinders 36 and 37 connected to the jumping roller 26. The jumping cylinders 36 and 37 may be connected to the jumping roller 26 by means of rings or the like so that they may not prevent rotation of the jumping roller 26.

A tubular takeup member 38 in the form of a paper tube or the like for winding a sheet-formed article 11 thereon is mounted for movement from and toward the conveyor belt 16 (up and down movement in the arrangement shown) and for rotation on and between a pair of arms 40 and 42 which are vertically adjustably secured to a frame (not shown). The lowermost position of the tubular takeup member 38 is adjusted in accordance with the thickness of a sheet-formed article by the up or down movement of the arms 40 and 42.

A presser 44 is connected to a presser cylinder 46 such that it may be extended in an inclined direction toward a position below the tubular takeup member 38.

Now, a description will be given of a winding operation of a sheet-formed article.

Figure 2:
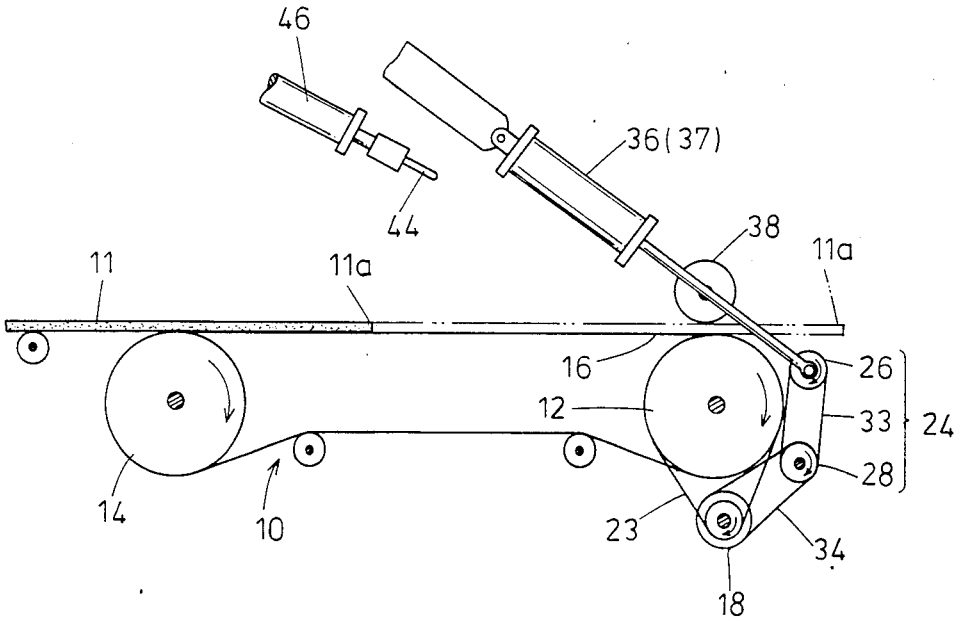
FIGS. 2 to 5 are side elevational views, in schematic representation, illustrating different stages of winding of a sheet-formed article on the winding apparatus of FIG. 1, FIG. 2 illustrating an initial stage of transportation of the sheet-formed article, FIG. 3 illustrating the next stage in which an end portion of the sheet-formed article is turned over, FIG. 4 illustrating a further next stage in which the end portion of the sheet-formed article is pushed to a position below a tubular takeup member, and FIG. 5 illustrating the final stage in which attaching of the sheet-formed article is completed.

A sheet-formed article 11 which is supplied continuously from a sheet-formed article forming apparatus (not shown) is transported toward the tubular takeup member 38 on the winding apparatus by the conveyor 10 as seen in FIG. 2. At this instant, the jumping cylinders 36 and 37 are in their expanded positions and the attaching roller assembly 24 is at a position forwardly of the driving drum 12 and hence below the sheet-formed article 11. The tubular takeup member 38 is secured to a position in which it is spaced from the conveyor belt 16 by a distance equal to or a little smaller than the thickness of the sheet-formed article 11.

Figure 3:
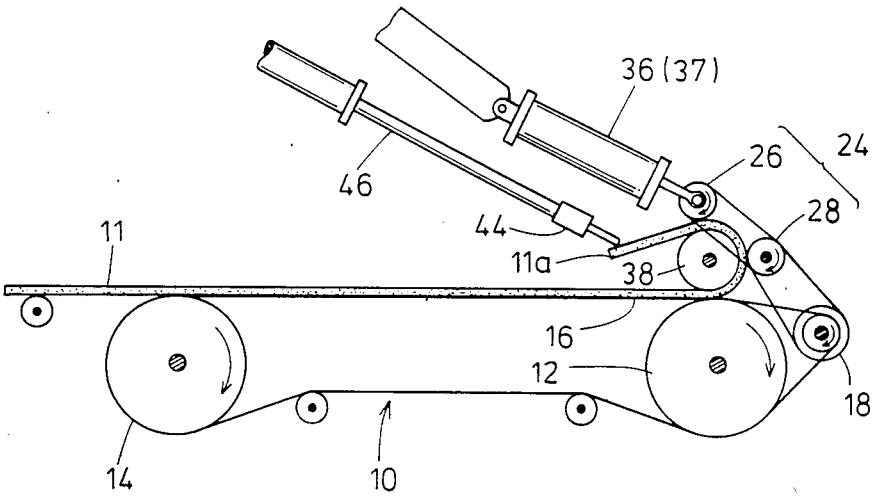
Figure 4:
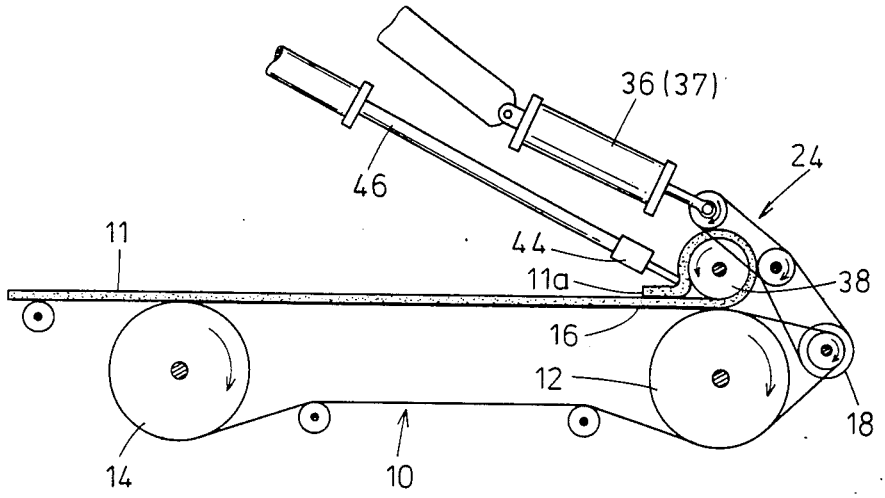

When the sheet-formed article 11 is further transported until an end 11*a* thereof extends a predetermined length forwardly from the tubular takeup member 38, preferably until the length of the extended end 11*a* from the tubular takeup member 38 becomes a little greater than the circumference of the tubular takeup member 38, the length is detected by means of a detecting device using an infrared ray or the like. As a result, the cylinders 36 and 37 are contracted as seen in FIG. 3 and the attaching roller assembly 24 is moved up above the driving drum 12. Thereupon, an end portion of the sheet-formed article 11 is moved up by the jumping roller 26 and is then pressed against the outer periphery of the tubular takeup member 38 by the jumping roller 26 and the backup roller 28 so that it surrounds the forward half peripheral portion of the tubular takeup member 38 and is turned over rearwardly. Then, when the turned over and 11*a* of the sheet-formed article 11 comes to a predetermined position, it is detected by a detecting device and the presser cylinder 46 is operated to expand itself until the presser 44 located at the end of the presser cylinder 46 pushes the end portion 11*a* of the sheet-formed article 11 to a position below the tubular takeup member 38 as seen in FIG. 4. Meanwhile, since the sheet-formed article 11 is continuously transported by the conveyor 10 and a portion near the end of thereof is pressed against the outer periphery of the tubular takeup member 38, a rotational force is applied to the tubular takeup member 38 in accordance with transportation of the sheet-formed article 11 by the conveyor 10 and the attaching roller assembly 24 so that the tubular takeup member 38 is rotated in integral relationship with the end of the sheet-formed article 11. Then, the end 11*a* of the sheet-formed article 11 is wrapped between the tubular takeup member 38 and the sheet-formed article 11 on the conveyor 10, thereby completing attaching of the sheet-formed article 11 to the tubular takeup member 38.

Figure 5:
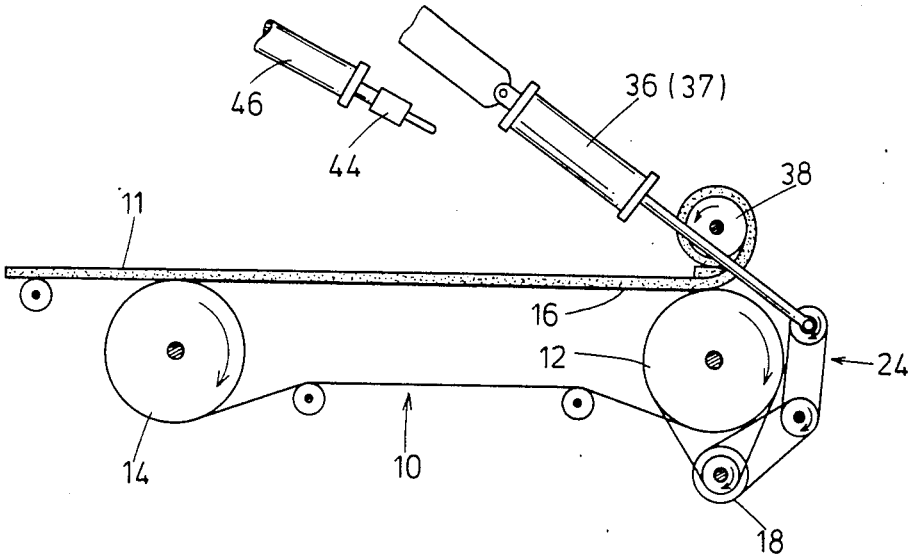

After completion of the attaching process, the jumping cylinders 36 and 37 are expanded again so that the attaching roller assembly 24 is moved back to the initial position forwardly of the driving drum 12. Then, the presser cylinder 46 is contracted so that the presser 44 is removed from the position below the tubular takeup member 38 and is moved to a position as seen in FIG. 5 in which it does not interfere with winding of the sheet-formed article 11. In this case, the tubular takeup member 38 is contacted with the belt 16 of the conveyor 10 via the sheet-formed article 11 wrapped around the tubular takeup member 38 and is thus transported continuously thereby. Accordingly, the tubular takeup member 38 is rotated at a rotational speed equal to the transporting speed of the sheet-formed article 11, effecting continuous winding of the sheet-formed article 11. Since the tubular takeup member 38 is mounted for movement from and toward the belt 16 of the conveyor 10, it moves upwardly over the driving drum 12 in accordance with the progressively increasing thickness of the sheet-forming article 11 wound in layers around the tubular takeup member 38 as winding of the sheet-formed article 11 proceeds.

As is apparent from the foregoing description, according to the invention, a winding apparatus is constituted such that an end portion of a sheet-formed article which is continuously transported by a conveyor is turned over to surround a substantially half peripheral portion of a tubular takeup member by means of an attaching roller assembly so that the sheet-formed article is pressed against the tubular takeup member and then the turned over end of the sheet-formed article is pushed to a position below the tubular takeup member by means of a presser so as to allow automatic winding of the sheet-formed article onto the tubular takeup member to be effected by rotation of the tubular takeup member.

The winding apparatus of the invention can be accommodated to any change of the thickness of the sheet-formed article by varying the lowermost position of the tubular takeup member, that is, the distance from a conveyor belt, when the sheet-formed article is to be attached to the tubular takeup member. Meanwhile, the maximum width of sheet-formed articles to be wound by the winding apparatus is only limited by the width of the conveyor belt, the width of each roller, and the like.

Accordingly, so far as the width of sheet-formed articles is within a predetermined fixed range, automatic winding can be continued even if a sheet-formed article of a different thickness or width is to be subsequently wound. Also in the case the thickness and width of a sheet-formed article to be wound vary continuously, automatic winding is also possible only by adjustment of the lowermost position of the tubular takeup member, that is, the distance from the conveyor belt.

As is apparent from the foregoing description, a winding apparatus according to the present invention allows automatic winding without being influenced by the material or dimensions of a sheet-formed article to be wound and is thus very effective for industrial applications.

Obviously, many variations and modifications of the present invention are possible in light of the above teachings. It is therefore to be understood that within the scope of the appended claims, the present invention may be practiced otherwise than as specifically described herein.

What is claimed is:

1. An apparatus for winding a sheet-formed article, comprising:

conveyor means for transporting said sheet-formed article in an advancing-winding direction;

a takeup member, disposed adjacent to said conveyor means for forming a nip through which said sheet-formed article is to be conveyed, upon which said sheet-formed article is to be wound;

means movably disposed between a first position upon one side of said nip and at which said means is disengaged from said sheet-formed article, and a second position upon the opposite side of said nip and at which said means is engaged with said sheet-formed article for causing a free end portion of said sheet-formed article to become wrapped about said takeup member;

transmission driving means, mounted upon said conveyor means for movement with respect to said conveyor means along with said movably disposed means when said movably disposed means is moved between said first and second positions and drivingly interconnecting said movably disposed means and said conveyor means, for driving said movably disposed means, in response to the transportation drive movement of said conveyor means, in said advancing-winding direction whereby said movably disposed means can drivingly advance said free end portion of said sheet-formed article while said conveyor means can drivingly advance a remaining portion of said sheet-formed article; and pressing means for tucking said free end portion of said sheet-formed article between said takeup member and said remaining portion of said sheet-formed article.

2. An apparatus according to claim 1, wherein said means (24) includes a pair of rollers (26, 28) mounted in a predetermined spaced relationship.

3. An apparatus according to claim 2, wherein said conveyor (10) includes a conveyor belt (16) and a driving drum (12) for driving said conveyor belt, and said rollers (26, 28) of said means (24) are connected to be rotated in the same direction with said driving roller by belt and pulley means.

4. An apparatus according to claim 3, wherein said rollers (26, 28) are moved from said first to said second position when an end of the sheet-formed article being fed extends by a length equal to or a little smaller than the circumference of said tubular takeup member (38) from said driving drum (12) of said conveyor (10).

5. An apparatus according to claim 2, wherein one of said rollers (26, 28) is connected to a cylinder (36, 37) for moving said rollers between said first and second positions.

6. An apparatus according to claim 1, wherein:

said pressing element means (44) is connected to a cylinder (46) so as to be moved toward and away from said position below said tubular takeup member (38).

7. An apparatus according to claim 1, wherein said tubular member (38) is supported for rotation and also for up and down movement on a pair of arms (40, 42), whereby said takeup member is naturally moved up on said arms by the sheet-formed article wound on said tubular takeup member as winding of the sheet-formed article onto said tubular takeup member proceeds.

8. An apparatus according to claim 7, wherein said arms (40, 42) are adjustable relative to said conveyor (10) so as to allow adjustment of the allowable lowermost position of said takeup member (38) thereon relative to said conveyor.

9. An apparatus for winding a sheet-formed article, comprising:

conveyor means for transporting said sheet-formed article in an advancing-winding direction;

takeup means, disposed adjacent to said conveyor means for defining a nip through the plane of which said sheet-formed article is to be conveyed, upon which said sheet-formed article is to be wound;

means movably disposed between a first position, upon one side of said nip plane and within the vicinity of said conveyor means, at which said means is disengaged from said sheet-formed article, and a second position, upon the opposite side of said nip plane and within the vicinity of said takeup means, at which said means is engaged with said sheet-formed article for causing a free end portion of said sheet-formed article to become wrapped about said takeup means;

transmission driving means, mounted upon said conveyor means for movement with respect to said conveyor means along with said movably disposed means with said movably disposed means is moved between said first and second positions and drivingly interconnecting said movably disposed and said conveyor means, for driving said movably disposed means, in response to the transportation drive movement of said conveyor means, in said advancing-winding direction whereby said movably disposed means can drivingly advance said free end portion of said sheet-formed article while said conveyor means can drivingly advance a remaining portion of said sheet-formed article; and pressing means for tucking said free end portion of said sheet-formed article between said takeup means and said remaining portion of said sheet-formed article.

10. Apparatus as set forth in claim 9, wherein:

said conveyor means comprises an endless belt conveyor.

11. Apparatus as set forth in claim 9, wherein:

said takeup means comprises a tubular roller.

12. Apparatus as set forth in claim 9, wherein:

said conveyor means comprises a driving drum;

said movably disposed means comprises a plurality of rollers; and said driving means comprises a plurality of belts and pulleys formed upon, and extending between, said conveyor driving drum and said rollers.

13. Apparatus as set forth in claim 12, further comprising:

piston-cylinder means connected to said rollers for moving said rollers between said first and second positions.

14. Apparatus as set forth in claim 13, wherein:

said piston-cylinder means is disposed upon said opposite side of said nip plane for moving said rollers between said one side of said nip plane and opposite side of said nip plane.

15. Apparatus as set forth in claim 12, wherein further:

said plurality of rollers comprises a pair of substantially vertically spaced rollers; and arm means fixedly interconnecting said pair of substantially vertically spaced rollers.

16. Apparatus as set forth in claim 15, further comprising:

piston-cylinder means connected to the upper one of said substantially vertically spaced rollers for moving said rollers between said first and second positions.

17. Apparatus as set forth in claim 9, further comprising:

piston-cylinder means connected to said pressing means for moving said pressing means toward and away from said nip plane.

18. Apparatus as set forth in claim 17, wherein:

said piston-cylinder means of said pressing means is disposed upon said opposite side of said nip plane.

19. Apparatus as set forth in claim 9, further comprising:

slotted arm means disposed upon said opposite side of said nip plane for supporting the opposite ends of said takeup means whereby said takeup means can automatically move within said slotted arm means in response to the thickness of said article wound upon said takeup means.

20. Apparatus as set forth in claim 19, wherein:

said slotted arm means are disposed substantially vertically upon opposite sides of said conveyor means.

* * * * *